United States Patent [19]

Sullivan

[11] 4,345,394

[45] Aug. 24, 1982

[54] POCKET SHEET INSERT SHEET ASSEMBLAGE AND METHOD OF USING THE ASSEMBLAGE

[76] Inventor: David T. Sullivan, 2 Westbrook Dr., Nashua, N.H. 03060

[21] Appl. No.: 275,353

[22] Filed: Jun. 19, 1981

[51] Int. Cl.[3] ..... B42F 19/00

[52] U.S. Cl. ..... 40/405; 40/124.2

[58] Field of Search ..... 40/124, 124.2, 124.4, 40/405, 530; 281/38, 15

[56] References Cited

U.S. PATENT DOCUMENTS

| | | | |
|---|---|---|---|
| 282,393 | 7/1883 | Sprague | 281/38 |
| 1,161,580 | 11/1915 | Allen | 40/530 |
| 1,352,728 | 9/1920 | Delaney | 40/124.4 |
| 4,055,008 | 10/1977 | Bell | 40/405 |
| 4,065,864 | 1/1978 | Stanley | 40/405 |
| 4,312,393 | 1/1982 | Green | 40/124.2 |

*Primary Examiner*—Gene Mancene
*Assistant Examiner*—Wenceslao J. Contreras

[57] ABSTRACT

An arrangement for providing a pocket sheet (10) having inserts (42) located in pockets of the pocket sheet with information placed on the inserts exposed. The arrangement involves providing an insert sheet (34) having substantially the same length and width as the pocket sheet, the insert sheet having a plurality of inserts (42) on which the information may be placed, after which the inserts may be separated from each other and placed in the pockets.

10 Claims, 3 Drawing Figures

POCKET SHEET INSERT SHEET ASSEMBLAGE AND METHOD OF USING THE ASSEMBLAGE

BACKGROUND OF THE INVENTION

It is known in the prior art to provide address labels for mailing pieces such as envelopes by typing the address information on a master sheet and then using a plain paper copying machine to copy the address information onto copy sheets formed of address labels adhered to backing sheets. The address labels, with the address information thereon, may then be removed from their backing sheets and adhered to mailing pieces. When the addresses are arranged in a desired order, such as in alphabetical order, this system has proven to be inconvenient as it is necessary to retype the master sheet when addresses are added or deleted.

SUMMARY OF THE INVENTION

In this invention, the necessity of retyping the master sheet is obviated by substituting therefor a pocket sheet, similar to that disclosed in U.S. Pat. No. 4,055,381, having pockets with removable inserts therein having the information thereon that may be copied onto the copy sheets. When the order of the information on the pocket sheets it be be altered, it is merely necessary to remove certain of the inserts from the pocket sheet, provide other inserts for the pocket sheet and, if necessary, alter the order of the inserts in the pocket sheet.

To provide the inserts for the pocket sheet, in accordance with this invention, an insert sheet is provided having substantially the same length and width as the pocket sheet. The insert sheet is divided into a plurality of inserts on which information may be placed, such information, for example, being names and addresses that may be typed on the inserts. After the information has been placed on the inserts, the inserts are separated from each other and inserted into the pockets of the pocket sheet.

The insert sheet and the pocket sheet form an assemblage that are stored toegether, preferably in a loose leaf binder, so as to be readily available when needed.

DESCRIPTION OF THE PREFERRED EMBODIMENT

Figure 1:
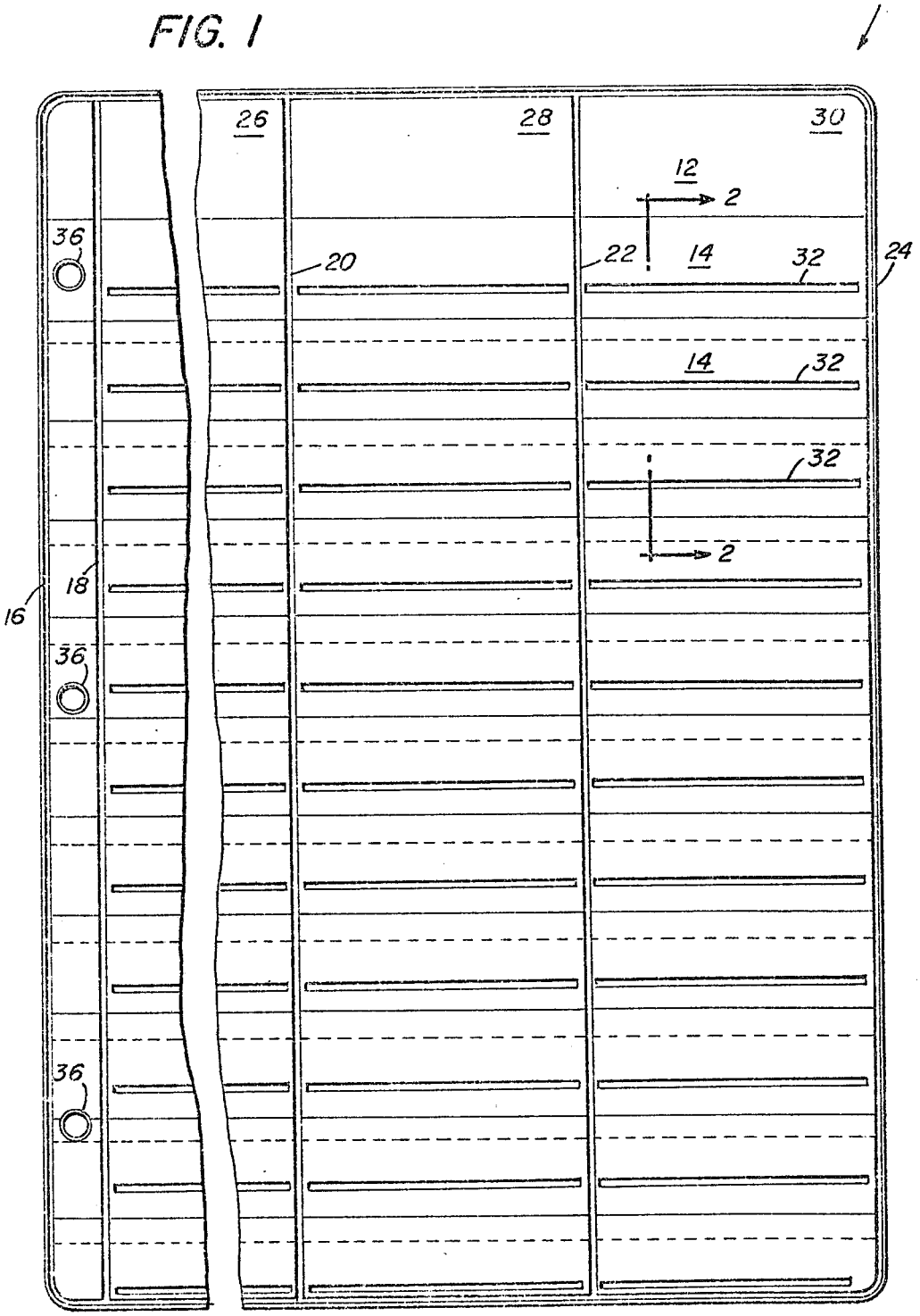
FIG. 1 is a view of the pocket sheet.
Figure 2:
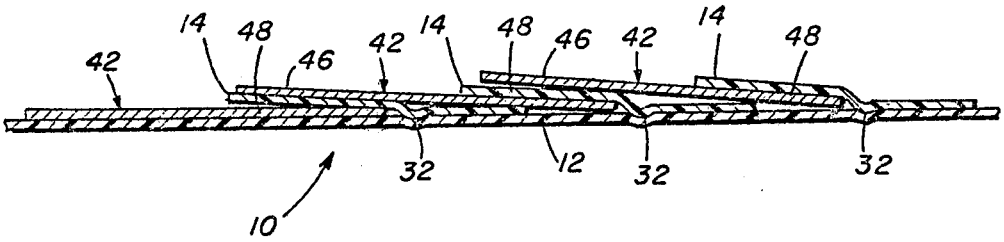
FIG. 2 is a section taken along the line 2—2 of FIG. 1 showing inserts in the pockets of the pocket sheet.

FIGS. 1 and 2 show a pocket sheet 10 made of layers of flexible plastic material such as polyvinyl. The sheet 10 includes a base layer 12 on which a plurality of bands 14 are superposed so as to extend widthwise of the base layer 12. The bands 14 are heat sealed to the base layer 12 by vertical seals 16, 18, 20, 22 and 24, the seals 16 and 24 being respectively located at the left and right sides of the sheet 10. The seals 18, 20 and 22 are spaced from each other and from the left and right sides of the sheet 10 to thereby form three columns 26, 28 and 30 of equal width. Each band 14 is connected to the base layer 12 by a horizontal heat seal 32 that extends between a pair of vertical seals and is between the top and bottom of its associated band 14.

Figure 3:
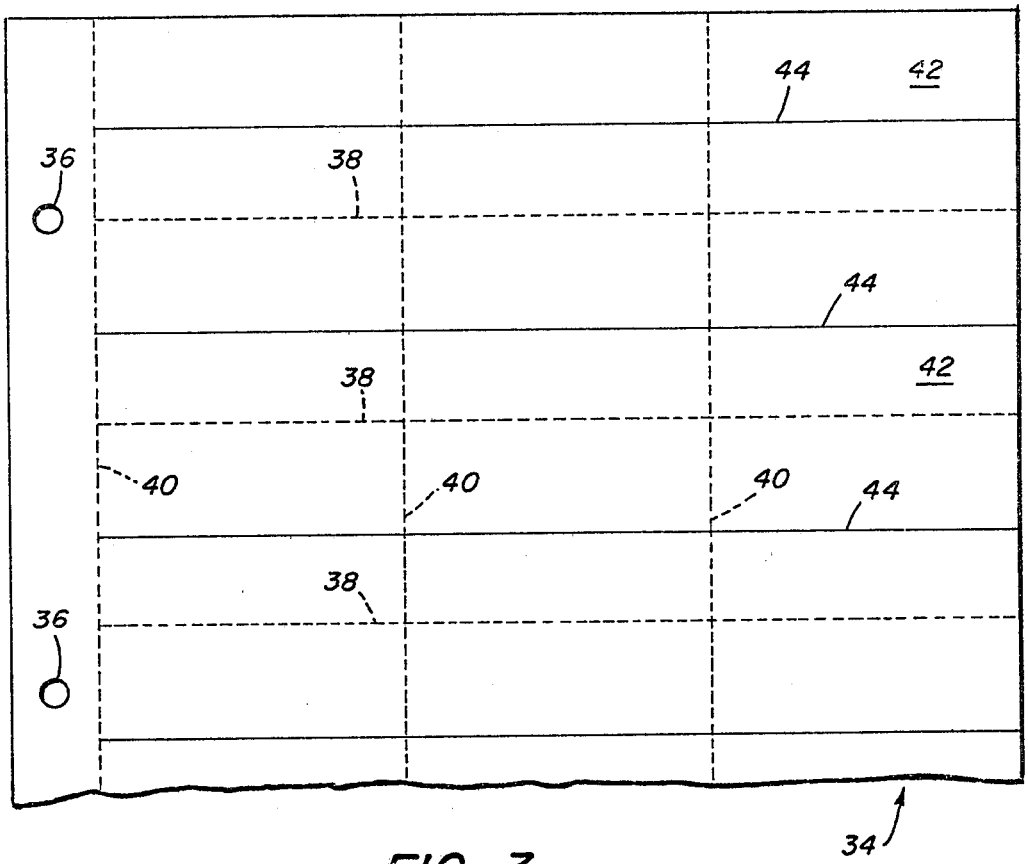
FIG. 3 is a view of the insert sheet.

FIG. 3 shows an insert sheet 34 formed of a flexible material on which information may be placed, such as paper. The sheets 10 and 34 have heights and widths that are approximately equal and have similarly located holes 36 along their left margins to enable them to be placed in and removed from a loose leaf binder. Horizontal score lines 38 and vertical score lines 40 in the sheet 34 divide the sheet into inserts 42 which may be separated from the sheet 34 and from each other by tearing along the score lines 38 and 40. Each insert 42 has a printed horizontal line 44 that divides the insert into an upper exposed portion 46 and a lower concealed portion 48.

The inserts 42 are of such a width that, when separated from each other and from the sheet 34, they can fit snugly between the vertical seams 18, 20, 22 and 24 into a pocket formed between the bottom of a first band 14 and the top of a second band 14 located beneath the first band 14 (see FIG. 2). The bottoms of the inserts 42 bear against the horizontal seams 32. The concealed portion 48 of each insert 42, when the inserts are in the pockets, is covered by the exposed portion 46 of the next lower insert 42.

In the use of the assemblage, an insert sheet 34 is removed from the loose leaf binder and placed in a typewriter. Information to be exposed, such as an individual's name and address, is typed on the exposed portions 46 of the inserts 42. If desired, information to be concealed, such as birth dates or subscription expiration dates, is typed on the concealed portions 48 of the inserts 42. The inserts 42 are then separated from each other and from the insert sheet 34 by tearing along the score lines 38 and 40. A pocket sheet 10 is then removed from the loose leaf binder and the separated inserts 42 are inserted into the pockets in the pocket sheet 10 in the manner described above in a desired order. For example, they can be inserted into the pockets in alphabetical order with reference to the names on the insert exposed portions 46. When names are to be removed from or added to the pocket sheet or the order of the names are to be changed, one merely removes appropriate inserts 42 from and adds appropriate inserts to the pocket sheet 10.

The pocket sheet 10 may be used for any desired purpose. For example, it may be placed as a master in a plain paper copying machine such as a Xerox machine and the information on the exposed portions 46 of the inserts 42 may be copied onto copy sheets. The copy sheets may be address labels that are adhered to a backing sheet that may be removed from the backing sheet and adhered to an envelope or other mailing piece after information has been copied onto the address labels from the copy sheet in the copying machine. As an alternative, the pocket sheet may be used to display desired information.

There follows a recapitulation of that portion of the disclosure that is germane to this invention.

This invention includes an assemblage comprised of at least one pocket sheet 10 and at least one insert sheet 34, the pocket sheet and the insert sheet having substantially equal lengths and widths. Each insert sheet 34 has a plurality of the inserts 42, on which information may be placed, that are separable from each other. Each pocket sheet has a plurality of pockets of such a size as to so receive an insert 42 as to expose information placed on the insert 42.

In using the assemblage, the information is placed on the inserts, the inserts are then separated from each other, and the separated inserts are then inserted into the pockets.

The insert sheet 34 has weakened lines 38, 40 that form the boundaries between the inserts 42 and along which the insert sheet may be torn to separate the inserts from each other.

Each insert 42 has a printed line 44 that separates each insert into the exposed portion 46 and the concealed portion 48. The pockets and the inserts are so constructed and arranged that when the inserts are located in the pockets the exposed insert portions 46 are visible and the concealed insert portions 48 are covered by contiguous inserts and are not visible.

Similarly located holes 36 are provided in the pocket sheet 10 and the insert sheet 34 to enable the sheets to be initially placed in a loose leaf binder and to enable the sheets to be removed from the binder prior to using them as described above.

I claim:

1. An assemblage comprising: at least one pocket sheet and at least one insert sheet, the pocket sheet and the insert sheet having substantially equal lengths and widths; each insert sheet comprising: a plurality of inserts on which information may be placed that are separable from each other; and each pocket sheet comprising: a plurality of pockets of such a size as to so receive an insert as to expose information placed on the insert.

2. The assemblage of claim 1 wherein the insert sheet has weakened lines that form the boundaries between the inserts and along which the insert sheet may be torn to separate the inserts from each other.

3. The assemblage of claim 1 or claim 2 further comprising a printed line in each insert that separates each insert into an exposed portion and a concealed portion; and wherein the pocket sheet, the pockets, and the inserts are so constructed and arranged that when the inserts are located in the pockets the exposed insert portions are visible and the concealed insert portions are covered by contiguous inserts and are not visible.

4. The assemblage of claim 1 or claim 2 further comprising similarly located holes in the pocket sheet and the insert sheet that enable the sheets to be removably placed in a loose leaf binder.

5. The assemblage of claim 3 further comprising similarly located holes in the pocket sheet and the insert sheet that enable the sheets to be removably placed in a loose leaf binder.

6. A method of providing a pocket sheet having a plurality of pockets that so receive inserts as to expose information placed on the inserts comprising: providing an insert sheet having a length and width substantially equal to the length and width of the pocket sheet and having a plurality of inserts that are separable from each other; placing information on the inserts; separating the inserts from each other; and inserting the inserts into the pockets in such a manner as to expose at least a portion of the information placed on the inserts.

7. The method of claim 6 wherein the insert sheet has weakened lines that form the boundaries between the inserts and further comprising: separating the inserts from each other by tearing the insert sheet along the weakened lines.

8. The method of claim 6 or claim 7 wherein the inserts each have a printed line that separates each insert into an exposed portion and a concealed portion; and wherein the pocket sheet, the pockets, and the inserts are so constructed and arranged that when the inserts are located in the pockets the exposed insert portions are visible and the concealed insert portions are covered by contiguous inserts and are not visible.

9. The method of claim 6 or claim 7 comprising: initially placing the insert sheet and the pocket sheet in a loose leaf binder; and removing both sheets from the binder prior to performing the aforementioned steps.

10. The method of claim 8 comprising: initially placing the insert sheet and the pocket sheet in a loose leaf binder; and removing both sheets from the binder prior to performing the aforementioned steps.

* * * * *